United States Patent [19]

Richmond, Jr.

[11] 4,264,263

[45] Apr. 28, 1981

[54] SMOKE SEAL FOR COKE OVEN PUSHER MACHINE LEVELER BAR

[75] Inventor: William C. Richmond, Jr., Hummelstown, Pa.

[73] Assignee: Bethlehem Steel Corporation, Bethlehem, Pa.

[21] Appl. No.: 949,940

[22] Filed: Oct. 10, 1978

[51] Int. Cl.[3] ..... C10B 45/00

[52] U.S. Cl. ..... 414/587; 202/270; 277/32

[58] Field of Search ..... 414/198, 587; 202/263, 202/269, 270; 432/244; 277/8 R, 32, 84; 308/6 R, 6 B

[56] References Cited

U.S. PATENT DOCUMENTS

| | | | |
|---|---|---|---|
| 981,732 | 1/1911 | Wilputte | 414/587 |
| 2,224,392 | 12/1940 | Imes | 414/587 X |
| 2,268,316 | 12/1941 | Taylor | 414/587 |
| 2,290,568 | 7/1942 | McIntosh | 414/587 |
| 3,097,892 | 7/1963 | Newbury | 308/6 R |
| 3,616,947 | 11/1971 | Tucker | 414/587 |
| 3,821,088 | 6/1974 | Barron | 202/269 |
| 3,950,228 | 4/1976 | Drebes | 414/587 X |

*Primary Examiner*—Robert G. Sheridan

*Attorney, Agent, or Firm*—Joseph J. O'Keefe; Charles A. Wilkinson; Michael Leach

[57] ABSTRACT

An apparatus for sealing the air gap between a leveler bar and the chuck door opening in a coke oven having spring loaded rollers as side and top seals between the leveler bar and a surrounding smoke seal box. The smoke seal box is pressed into a sealing engagement with the frame surrounding the chuck door opening via a spring plate assembly. Also a swing gate assembly provides a coal seal between the bottom of the smoke seal and the bottom of the leveler bar.

12 Claims, 5 Drawing Figures

SMOKE SEAL FOR COKE OVEN PUSHER MACHINE LEVELER BAR

FIELD OF THE INVENTION

The present invention relates to coke ovens and more particularly to an improved smoke seal for a coke oven leveler bar.

BACKGROUND OF THE INVENTION

It is well known that a coal charge in a coke oven is leveled using a leveler bar mounted on a pusher machine. The leveler bar is inserted into a chuck door opening (leveler bar opening) in the oven. While the leveler bar is inserted through the open chuck door and is reciprocating within the coke oven chamber to level the mounds of charged coal, pollutant gases can escape from the over chamber via the space between the sides of the chuck door opening and the leveler bar. Of even greater concern, air can enter the chuck door opening in a reverse direction causing vast amounts of polluting gases to escape from the charging holes at the top of the oven. Where charging cars are equipped to simultaneously charge coal into an oven, collect escaping smoke and gases and convey them into an adjacent oven, excessive in-rushing air during leveling of the charge creates a greatly increased flow of gases that may overwhelm the environmental controls on the charging car causing excess gases to escape into the atmosphere.

Early attempts at sealing the gap between the leveler bar and chuck door opening were the smoke seals disclosed in U.S. Pat. No. 2,268,316 to Taylor and U.S. Pat. No. 2,290,568 to McIntosh. These smoke seals were basically sleeves surrounding the leveler bar with a flanged front end pressed in a sealing engagement around the chuck door opening.

An improvement revealed in U.S. Pat. No. 3,821,088 to Barron provides a relatively gas-tight seal on each side of the leveler bar by urging with a yieldable mechanism two plates into a substantially perpendicular and rigid scraping contact with the side members of the leveler bar. A slidable cover plate provides a top seal while the coal withdrawn by the leveler bar into the smoke sleeve seals the bottom. While this smoke seal did afford better sealing, considerable air still passed into the over chambers. In addition, for this leveler bar seal to be effective, the leveler bar must be straight and perfectly maintained to ensure close tolerance contact with the machine fitted seal plates. Leveler bars become worn and warped through use, thus adversely affecting the sealing capabilities of these top and side seals. Of even greater concern is the fact this the smoke seal can become "frozen" in 5–7 days of continuous operation by the accumulation of tars. As the position of the leveler bar varies while reciprocating, during leveling, the side seal plates may no longer freely respond in a scraping contact with the side members of the leveler bar because of these tar deposits. Furthermore, the top seal plate, which does not readily slide on the top of the leveler bar nor ride up and down easily in the presence of a significant deposit of tars, may be sheared off if it becomes "frozen" by an excessive accumulation of tars and dirt. Extensive maintenance may thus be required.

There is thus a need for an improved gas seal between the leveler bar and chuck door opening. There is also a need for a smoke seal that operates effectively with worn and warped leveler bars as well as with those in good condition.

There is a further need for a smoke seal that will not become "frozen" and can be operated over extended periods without extensive maintenance.

SUMMARY OF THE INVENTION

The foregoing difficulties in the efficient operation of a smoke seal sleeve that is mounted on a pusher machine and is adapted for sealing arrangement with a chuck door opening in a coke oven have been substantially eliminated with the present invention. The smoke seal has a housing formed by a pair of spaced side walls, a top wall and a bottom wall. The smoke seal is adapted to permit a leveler bar formed by a pair of spaced side members connected by cross members to freely move within the smoke seal and chuck door opening to level coal. A first spring-loaded and pivotally mounted sealing means assembly is positioned within the smoke seal housing in contact with one side wall and one side member of the leveler bar. A second oppositely disposed spring-loaded and pivotally mounted sealing means assembly within the smoke seal housing is in contact with the other side wall and the other side member of the leveler bar. Preferably the pivotally mounted sealing means of the side spring-loaded sealing assemblies are rollers that are rotatably mounted. A top seal in contact with the top wall of the smoke seal and the top of the leveler bar is provided. Preferably a third spring-loaded and pivotally mounted sealing means assembly forms the top seal. More preferably the pivotally mounted sealing means of the top spring-loaded sealing assembly is a roller that is rotatably mounted. To afford a better coal seal between the bottom of the leveler bar and the bottom wall of the smoke seal a counterweighted swing gate is provided in the base of the smoke seal box.

DETAILED DESCRIPTION OF THE INVENTION

Figure 1:
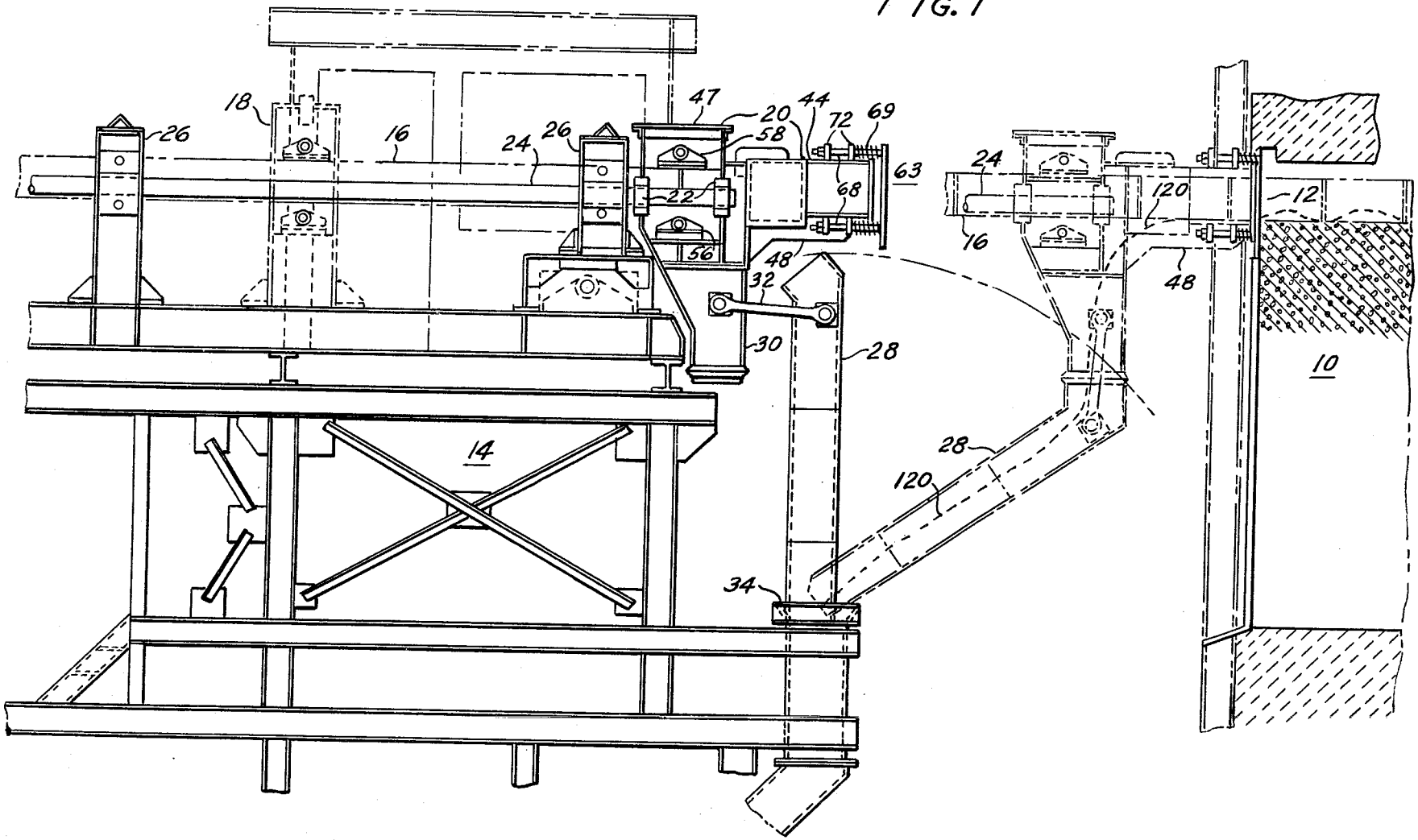
FIG. 1 shows a side view of a smoke seal mounted on a coke oven pusher machine in both the leveling and retracted position.

The preferred embodiment is described now by referring more particularly to the FIGURES. In FIG. 1 a conventional by-product coke oven is shown generally as 10 with a chuck door opening 12 for insertion of leveler bar 16. Pusher machine 14 is mounted on rails, not shown, that run along the push side of the coke oven battery transverse to the individual coke ovens. Leveler bar 16 is mounted on the pusher machine by support members 18 that contain guide rollers for movement and reciprocating action of the bar. Smoke seal 20 is attached by clamps 22 to guide rods 24 which horizontally ride on guide rod rollers within guide rod support members 26. When smoke seal 20 is pressed against coke oven 10 in a sealing engagement by a self-contained hydraulic system not shown, spillage chute 28 is pivoted into position beneath the smoke seal housing extension 30 by pivoting arm 32. Spillage chute 28 conveys coal 120 that is withdrawn from the oven by the retracting motion of the leveler bar into a receptacle 34 that can be mounted on the pusher machine 14.

Figure 2:
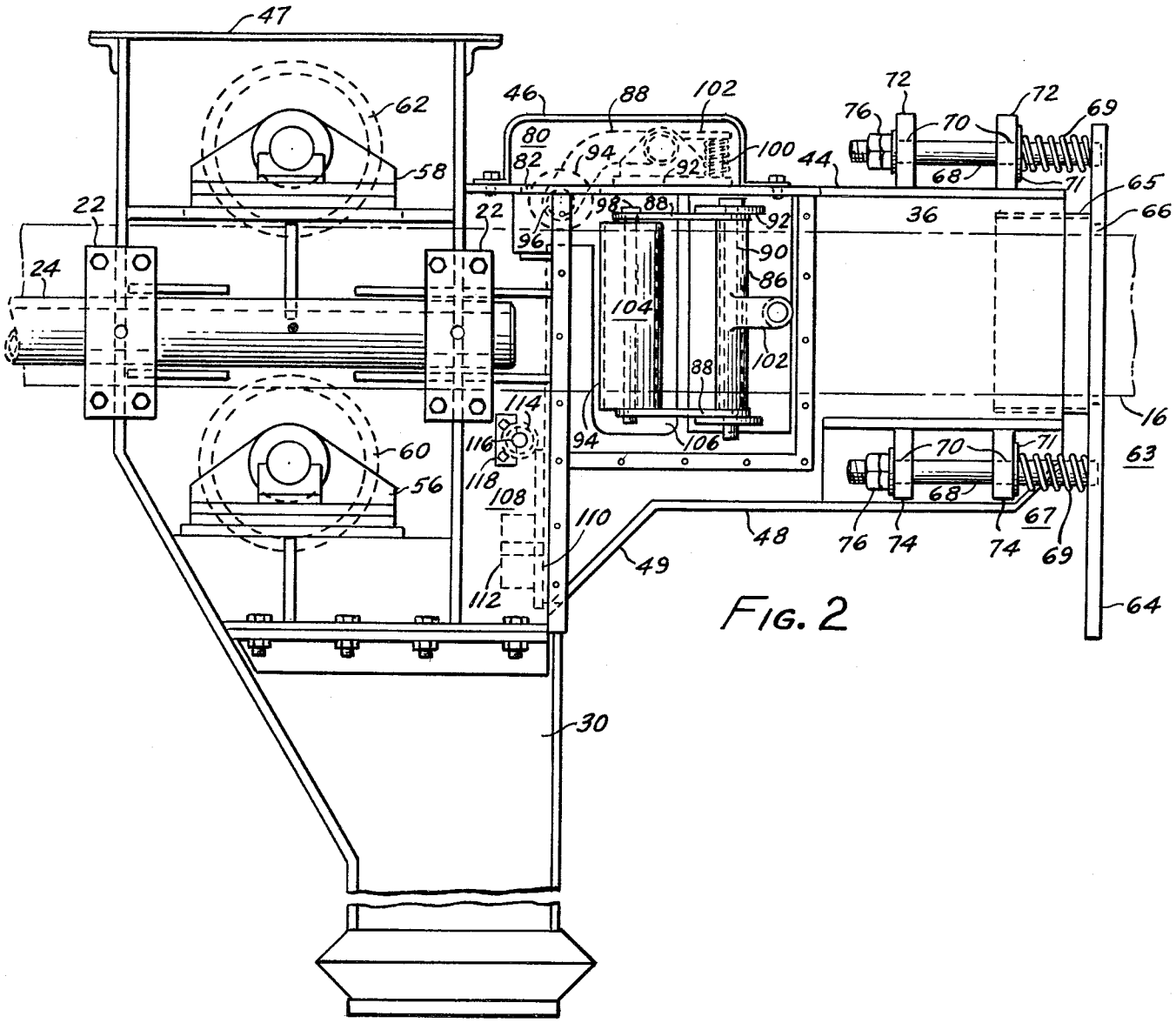
FIG. 2 is an enlarged side elevation partly in section of a preferred embodiment of the smoke seal in which the sealing means are rollers.
Figure 3:
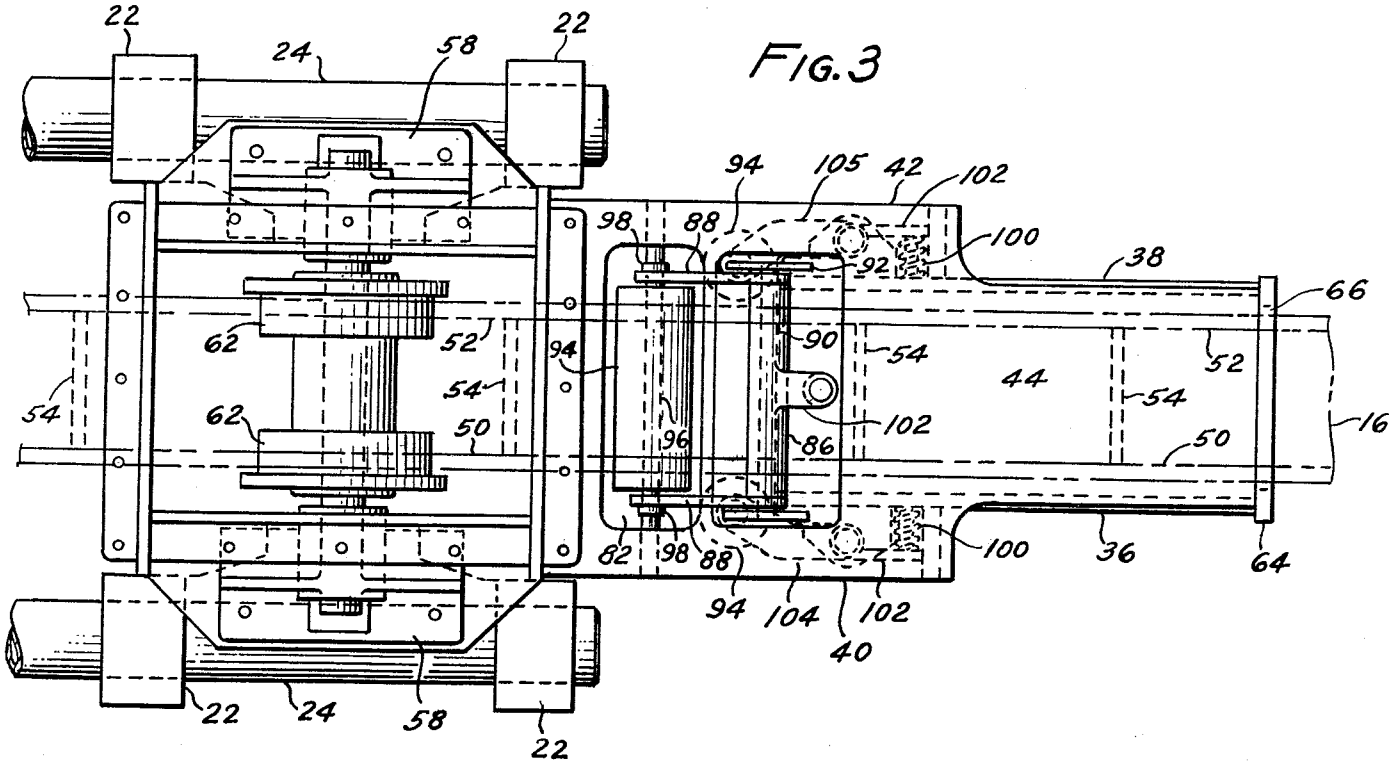
FIG. 3 is a top view of FIG. 2.

Referring to FIGS. 2 and 3 the housing of smoke seal 20 is formed by a pair of side walls 36 and 38 having side roller covers 40 and 42, respectively, a top wall 44 having a top roller cover 46 and top cover 47, and bottom wall 48. The downwardly inclined end 49 of bottom wall 48 and the lower end of each side wall are connected to smoke seal housing extension 30. A guide rod 24 is attached to the outside of each side wall by clamps 22. A back wall having a passage for the leveler bar may be provided to partially close off the rear opening formed by the side and top walls with the housing extension.

Extending within smoke seal 20 is leveler bar 16 which is formed by a pair of spaced side members 50 and 52 connected by cross members 54. Side members 50 and 52 are parallel and substantially the same height and cross members 54 extend almost the full height of side members 50 and 52. Secured to the side walls of the smoke seal housing are two pairs of guide roller supports 56 and 58 for supporting guide rollers 60 and 62, respectively, within the smoke seal. Guide rollers 60 and 62 are disposed parallel to and between the side walls and contact the lower and upper edges, respectively, of the leveler bar side members to assist the leveler bar in its movement within the smoke seal.

To effect the sealing engagement with the chuck door opening in the coke oven there is spring plate assembly 63 comprising a spring plate 64 having a passage 66 through which leveler bar 16 can extend. Surrounding the periphery of passage 66 on the inside of spring plate 64 is a rectangular tube-like sleeve 65 that extends partially into the front opening of the smoke seal housing to act as a telescoping extension. Spring plate 64 is secured to the top and bottom walls of the smoke seal by yieldable means 67. Yieldable means 67 comprises sliding rods 68 fastened at one end to the spring plate 64; the rods pass through compressor springs 69, washers 71 and through slots 70 of the pairs of blocks 72 and 74 which are fastened to the top and bottom walls. The other end of the rods is threaded through a washer, jamb nut and hex nut collectively identified as fastening means 76. The cooperative action of the compressor springs 69, which are disposed between the spring plate 64 and the first block, and the fastening means 76 on the opposite side of the second block resiliently holds the spring plate 64 in a position slightly apart from the smoke seal housing.

Top roller seal assembly 80 is mounted on top wall 44 and is covered by top roller cover 46 which also encloses slot 82 in top wall 44. Top roller seal assembly 80 comprises pivoting shaft 86 having rocker arms 88 secured to each end and rod 90 extending through an axial passage in pivoting shaft 86 and holes in an end of the rocker arms. Rod 90 is fixed by keeper plate base assembly 92 to permit pivoting movement by pivoting shaft 86. Disposed between the other end of the rocker arms 88 which extends downward through slot 82 is top roller 94 which is mounted for rotating movement on shaft 96 which extends through an axial bore in the top roller 94 and holes in the rocker arms 88 and are fixed by keeper 98. The top roller is yieldably maintained in contact with the top of leveler bar 16 by compression spring means 100 interposed between keeper plate base assembly 92 and arm 102 extending from the top of pivoting shaft 86.

Side roller seal assemblies 104 and 105 are mounted on side walls 36 and 38 within side roller covers 40 and 42, respectively. Side roller seal assemblies 104 and 105 are constructed like top roller seal assembly 80 with like assembly elements having the same identification numbers. Therefore, the description will not be repeated. Side rollers 94 yieldably contact a side member of leveler bar 16 through slot 106 in the side walls of the smoke seal housing.

Figure 5:
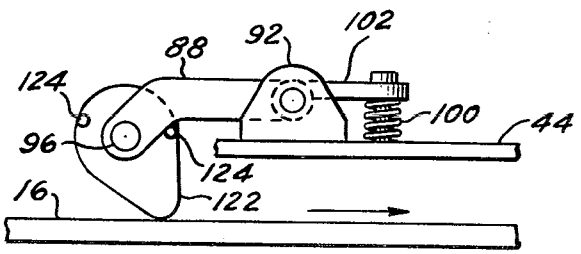
FIGS. 4 and 5 show an alternate form of sealing means in enlarged view.
Figure 4:
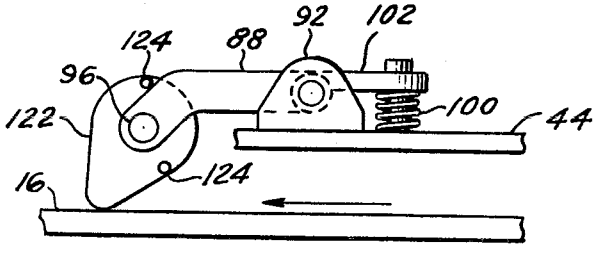

While a roller 94 is the preferred sealing means of the invention as illustrated in FIGS. 2 and 3, any geometric shape may be employed as the sealing means which is spring-loaded to effect a sealing contact with the members of the leveler bar 16. This geometric shape, however, must be mounted so that it pivots in an arc to afford a flexible gas sealing contact with the leveler bar surface. Such geometric shapes may be, for example, a wedge or a plate. In FIGS. 4 and 5, the sealing means is depicted as a wedge 122 disposed between the ends of rocker arms 88 and is mounted for pivotal movement on shaft 96 which extends through a bore in the wedge. Being mounted for pivotal movement the wedge is in sealing contact with the leveler bar 16 at an acute angle to the perpendicular to the leveler bar whenever there is lateral movement of the leveler bar. Rather than being rigidly fixed between the rocker arms 88 in a firm scraping, sealing contact with the leveler bar, the sealing means can readily pivot about shaft 96 in the direction of the leveler bar movement. Thus a smooth sealing contact is maintained that permits ease of leveler bar reciprocation. It is preferable that the pivoting of the wedge be restricted by arrestors 124 so that the sealing contact is limited to an acute angle that enables free pivoting to the opposite direction when the movement of leveler bar is reversed. This can be seen by comparing the position of the edge of the wedge 122 that gas sealingly contacts the leveler bar surface in relation to the direction of the leveler bar movement as indicated by the arrows in FIGS. 4 and 5. The spring-loaded sealing means can be any spring-loaded geometric shape what wipes the surface of the leveler bar which it sealingly contacts.

Swing gate assembly 108 is disposed within the smoke seal housing and comprises gate plate 110 having fixed to its lower end counterweight 112 and having attached to its upper end a pivoting shaft 114 positioned between and rotatably fastened on either end to side walls 36 and 38 by pivot rod 116 and brackets 118.

In operation, pusher machine 14 is positioned in front of chuck door opening 12 and smoke seal 20 is moved forward on the guide rollers within guide rod support members 26 until the spring plate 64 comes into sealing engagement around the opened chuck door opening. Leveler bar 16 is moved within smoke seal 20 and into chuck door opening 12. Side roller seal assembly 104 seals the air gap between side member 50 and side wall 36 of the smoke seal housing while side roller seal assembly 105 seals the air gap between side member 52 and side wall 38. Rollers 94 of the side roller seal assemblies 104 and 105 are free to independently move or float within side seal roller covers 40 and 42, respectively, in response to any side-to-side movement of the leveler bar or to any deformation of the side members. Rollers 94 of the side roller seal assemblies 104 and 105 are maintained in contact with side members 50 and 52 of leveler bar 16 by cooperative action of the pivoting shaft 86 and compression spring means 100.

Top roller seal assemby 80 seals the air gap between the top wall 44 of the smoke seal housing and the top of leveler bar 16. The roller 94 of the top roller seal assembly 80 is free to move or float up and down within top roller cover 46 in response to any similar movement of leveler bar 16 or any variation in the height of leveler bar 16.

The air gap between the bottom of leveler bar 16 and bottom wall 48 is sealed by coal 120 which is pulled out of coking chamber 10 during the retracting movement of the reciprocating leveler bar 16 as shown in FIG. 1. A more positive seal is achieved by the counterweighted swing gate 108, not shown in FIG. 1, retaining a sufficient amount of coal 120. As excess coal is forcefully pulled out by the leveler bar 16, swing gate 108 swings away to permit some of the coal to slide down the inclined end 49 of the bottom wall 48 into smoke seal housing extension 30 and downward to receptacle 34 via spillage chute 28.

Spring plate assembly 63 was added to the smoke seal housing to permit sealing engagement with the chuck door opening to be achieved more smoothly and with less damage to the coke oven doors. The chuck door is generally located in the oven door mounted on the push side of the coke ovens. Without such a spring plate assembly the mechanism for moving the smoke seal into position would cause the smoke seal to abruptly and forcefully contact the area of the oven door surrounding the chuck door opening either jarring loose the luting or damaging the knife-point seals with a resulting loss in the gas sealing effectiveness of the oven door. Spring plate assembly 63 absorbs the shock of contact between the smoke seal and oven door through yieldable means 67.

I claim:

1. In combination with a coke oven having a chuck door opening, a pusher machine having a smoke seal formed by a pair of spaced side walls, a top wall and a bottom wall and adapted for sealing engagement with the opening, which pusher machine has guide rollers for guiding a leveler bar formed by a pair of spaced side members connected by cross members, which leveler bar is adapted for movement within the smoke seal and the chuck door opening to level coal in the coke oven, the improvement comprising:

(A) a first spring-loaded and rotatably mounted roller side gas seal assembly in gas sealing contact with one side wall of the smoke seal and one side member of the leveler bar and a second oppositely disposed spring-loaded and rotatably mounted roller side gas seal assembly in gas sealing contact with the other side wall of the smoke seal and the other side member of the leveler bar; and (B) a top seal in gas sealing contact with the top wall of the smoke seal and the top of the leveler bar.

2. The invention of claim 1 wherein the top seal is a spring-loaded and rotatably mounted roller gas seal assembly.

3. The invention of claims 1 or 2 wherein the spring-loaded and rotatably mounted roller gas seal assembly comprises (i) a pivoting shaft having one end of a rocker arm secured to the pivoting shaft, the pivoting shaft being fixed for pivoting movement to a base assembly mounted on the wall, (ii) a roller which is mounted for rotating movement on the other end of the rocker arm, and (iii) a compression spring means interposed between the base assembly and an arm extending from the pivoting shaft whereby the roller is yieldably maintained in gas sealing contact with the leveler bar.

4. The invention of claim 1 or 2 which further includes (C) a swing gate assembly disposed within the smoke seal for maintaining a coal seal between the bottom of the smoke seal and the bottom of the leveler bar.

5. The invention of claim 4 wherein the swing gate assembly comprises:

(i) a gate plate having a counterweight fixed to its lower end, and (ii) a pivoting shaft attached to the upper end of the gate plate and positioned between and rotatably fastened on either end to the side walls.

6. The invention of claim 4 which further includes (D) a spring plate assembly mounted on the smoke seal for effecting a sealing engagement between the smoke seal and the chuck door opening.

7. The invention of claim 6 wherein the spring plate assembly comprises:

(i) a spring plate having a passage through which the leveler bar can extend and a tube-like sleeve surrounding the periphery of the passage and extending into the smoke seal, and (ii) yieldable means for yieldably securing the spring plate to the smoke seal.

8. The invention of claim 7 wherein the yieldable means comprises a sliding rod fastened at one end to the spring plate, the rods passing through a compressor spring, washer and a pair of blocks which are mounted on the smoke seal and secured with fastening means.

9. In combination with a coke oven having a chuck door opening, a pusher machine having a smoke seal formed by a pair of spaced side walls, a top wall and a bottom wall and adapted for sealing engagement with the opening, which pusher machine has guide rollers for guiding a leveler bar formed by a pair of spaced side members connected by cross members, which leveler bar is adapted for movement within the smoke seal and the chuck door opening to level coal in the coke oven, the improvement comprising:

(A) a first spring-loaded and pivotally mounted side gas sealing means assembly in gas sealing contact with one side wall of the smoke seal and one side member of the leveler bar and a second oppositely disposed spring-loaded and pivotally mounted side gas sealing means assembly in gas sealing contact with the other side wall of the smoke seal and the other side member of the leveler bar; and (B) a top seal in gas sealing contact with the top wall of the smoke seal and the top of the leveler bar.

10. The invention of claim 9 in which the top seal is a spring-loaded and pivotally mounted gas sealing means assembly.

11. The invention of claim 9 or 10 which further includes (C) a swing gate assembly disposed within the smoke seal for maintaining a coal seal between the bottom of the smoke seal and the bottom of the leveler bar.

12. The invention of claim 11 which further includes (D) a spring plate assembly mounted on the smoke seal for effecting a sealing engagement between the smoke seal and the chuck door opening.

* * * * *